US007199808B2

(12) United States Patent
Yo

(10) Patent No.: US 7,199,808 B2
(45) Date of Patent: Apr. 3, 2007

(54) LIQUID CRYSTAL DISPLAY

(75) Inventor: Seiji Yo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 530 days.

(21) Appl. No.: 10/743,768

(22) Filed: Dec. 24, 2003

(65) Prior Publication Data

US 2004/0189571 A1 Sep. 30, 2004

(30) Foreign Application Priority Data

Dec. 25, 2002 (JP) ..... 2002-375665

(51) Int. Cl.
*G09G 5/02* (2006.01)
*G09G 3/36* (2006.01)

(52) U.S. Cl. ..... 345/694; 345/690; 345/88; 345/90; 349/84; 349/144

(58) Field of Classification Search ..... 345/87–102, 345/690–699
See application file for complete search history.

(56) References Cited

U.S. PATENT DOCUMENTS

| | | | | |
|---|---|---|---|---|
| 6,335,778 | B1 | 1/2002 | Kubota et al. | |
| 6,714,212 | B1 * | 3/2004 | Tsuboyama et al. | 345/696 |
| 6,909,442 | B2 * | 6/2005 | Hiyama et al. | 345/690 |
| 2002/0075211 | A1 | 6/2002 | Nakamura | |

FOREIGN PATENT DOCUMENTS

| | | |
|---|---|---|
| JP | 6-138844 | 5/1994 |
| JP | 7-261155 | 10/1995 |
| JP | 10-68931 | 3/1998 |
| JP | 10-177181 | 6/1998 |
| KR | 10-0291158 | 6/2001 |
| KR | 1020020019416 | 3/2002 |

OTHER PUBLICATIONS

Korean Office Action dated Nov. 16, 2005.

* cited by examiner

*Primary Examiner*—Richard Hjerpe
*Assistant Examiner*—Duc Dinh
(74) *Attorney, Agent, or Firm*—Harness, Dickey & Pierce, P.L.C.

(57) ABSTRACT

The present invention aims at providing a liquid crystal display which can reproduce images in a uniform manner. In a liquid crystal display which adopts an area ratio gray scale and includes pixels each having a plurality of sub-pixels, the sub-pixel includes a sub-pixel electrode and two TFTs, and is connected to a common line to which a predetermined voltage is applied. To the source electrode and drain electrode of one TFT, the drain electrode of the other TFT and the sub-pixel electrode are connected, respectively. To the source electrode of the other TFT, either a scanning signal line or a data signal line is connected. Meanwhile, to the gate electrode of said one TFT, either the scanning signal line or the data signal line which is not connected to the gate electrode of the other TFT is connected.

5 Claims, 9 Drawing Sheets

LIQUID CRYSTAL DISPLAY

This Nonprovisional application claims priority under 35 U.S.C. § 119(a) on Patent Application No. 2002/375665 filed in Japan on Dec. 25, 2002, the entire contents of which are hereby incorporated by reference.

FIELD OF THE INVENTION

The present invention relates to a liquid crystal display, and more particularly to a liquid crystal display adopting a digital-drive area ratio gray scale.

BACKGROUND OF THE INVENTION

In conventional TFT liquid crystal panels, the reversal of a liquid crystal element is controlled by applying an analog voltage to a pixel electrode using a D/A converting source driver. As a result of upsizing, such liquid crystal panels have headaches in, for instance, moving image characteristics (speed of response), viewing angle, luminance shifting and angle shifting of colors, V-T accuracy, and uniformity of in-plane luminance distribution. These problems are caused by the following two electrical issues.

The capacitive driving force and the accuracy of an output of a source driver are the first issue.

The second issue is, as in FIG. 9, that voltage characteristics greatly differ between pixels at different positions (between a pixel (pixel 1) near the source driver and a pixel (pixel 2) far from the source driver). That is, when a single color is displayed on a whole liquid crystal panel, i.e. when identical signals are supplied to all pixels, even if identical voltages should have been applied to pixels at different positions (i.e. pixels 1 and 2) with little time difference, in reality different voltages are applied to the respective pixels. As a result, the rise of the pixel 2 is not immediately carried out so that the drive period of liquid crystal in the pixel 2 is shortened, and the pixel 2 is not sufficiently charged.

To resolve these issues, Japanese Laid-Open Patent Application No. 7-261155/1995 (Tokukaihei 7-261155; published on Oct. 13, 1995), U.S. Pat. No. 6,335,778 (registered on Jun. 1, 2002) corresponding to Japanese Laid-Open Patent Application No. 10-68931 (Tokukaihei 10-68931; published on Mar. 10, 1998), and Japanese Laid-Open Patent Application No. 6-138844 (Tokukaihei 6-138844; published on May 20, 1994) teach the adoption of an area ratio gray scale against a liquid crystal display. According to these publications, one pixel includes a plurality of sub-pixels and the tone of the pixel is determined by the number of electrodes in the sub-pixels being turned on. In this manner, since binary driving is carried out when the area ratio gray scale is adopted, the first issue can be resolved.

However, the binary-driving liquid crystal panel and an analog liquid crystal panel are identical to the extent that a signal voltage is applied to pixel electrodes via source lines. Thus, as in the case of a liquid crystal panel to which an analog voltage is applied, pixels at different positions receive different voltages so that the time necessary for the rise and the amount of change are different between these pixels. In short, the second issue cannot be resolved. The time difference of the drive of liquid crystal between pixels at different positions occurs because the pixels at different positions are not equidistant from the source driver. Furthermore, the difference of voltages applied to the respective pixels at different positions occurs because the attenuation of a source drive voltage applied to the pixels at different positions, as a result of RC components of source lines, varies in accordance with the length of the source line. There have been attempts to improve the speed of response of a liquid crystal panel by means of graphic data processing (overshoot), but it has been difficult to determine the amount of compensation in view of, for instance, the variation of the speed of reversal due to the temperature variation of the liquid crystal. Also, when the liquid crystal display adopting the area ratio gray scale reproduces a low-luminance image, the image appears unnatural and jaggy due to the pixels, i.e. pixels appear to be distanced from each other. For this reason, it has been difficult to reproduce smooth images by a liquid crystal display.

The present invention is done to solve the above-described problem. The objective of the present invention is to provide a liquid crystal display which can reproduce smooth images.

SUMMARY OF THE INVENTION

To solve the problem as addressed, the liquid crystal display of the present invention, comprises: a plurality of data signal lines; a plurality of scanning signal lines intersecting with said plurality of data signal lines; and a plurality of pixels provided in a matrix manner at respective intersections of said plurality of data signal lines and said plurality of scanning signal lines, each of said plurality of pixels including a plurality of sub-pixels driven in a binary manner, the liquid crystal display being characterized in that, each of said plurality of sub-pixels includes a sub-pixel electrode, a first thin film layer transistor, and a second thin film transistor, and is connected to a common line to which a predetermined voltage is applied, a source electrode and a drain electrode of the second thin film layer transistor are connected to a drain electrode of the first thin film transistor and the sub-pixel electrode, respectively, and a source electrode of the first thin film layer transistor is connected to the common line, and a gate electrode of the first thin film layer transistor is connected to one of said plurality of scanning signal lines or one of said plurality of data signal lines, and a gate electrode of the second thin film layer transistor is connected to one of said plurality of scanning signal lines or one of said plurality of data signal lines, which is not connected to the gate electrode of the first thin film layer transistor.

According to this arrangement, immediately after the application of the source signal or gate signal to the gate electrode of the first thin film layer transistor or the second thin film layer transistor, either the first thin film layer transistor or the second thin film layer transistor is turned on. This is because the gate electrode of the first thin film layer transistor or the second thin film layer transistor has a high impedance. On this occasion, the source electrode of the first thin film layer transistor is receiving a voltage commonly supplied to all sub-pixel electrodes, via the common line. Thus, it is possible to apply the voltage of the common line to the sub-pixel electrode. Furthermore, when the data signals are supplied from the data signal line drive circuit to the data signal lines, the source signals may be attenuated due to reasons such as the resistance of the source signal lines themselves, if the distances between the sub-pixel electrodes to the source signal line drive circuit are not identical. The arrangement above makes it possible to apply, without the attenuation, a uniform voltage to the sub-pixel electrodes, and hence all of the sub-pixel electrodes can be charged in an identical manner.

Thus, when a single color is displayed on a whole liquid crystal panel, i.e. when identical signals are supplied to all pixels, a uniform voltage can be supplied to different sub-pixel electrodes, and this makes it possible to improve the speed of electric charge of the different sub-pixel electrodes. With this, different pixels can carry out the image reproduction in a substantially uniform manner, and this makes it possible to perform uniform image reproduction on a large-sized liquid crystal display. Furthermore, the gate electrode of the first thin film transistor or the second thin film transistor has a high impedance, the data signal line can be thinned down.

To solve the foregoing problem, the liquid crystal display of the present invention, including: a plurality of data signal lines; a plurality of scanning signal lines intersecting with said plurality of data signal lines; and a plurality of pixels provided in a matrix manner at respective intersections of said plurality of data signal lines and said plurality of scanning signal lines, each of said plurality of pixels including a plurality of sub-pixels driven in a binary manner, is characterized by further comprising a light diffusion layer by which light emitted from one of said plurality of sub-pixels is diffused so as to cover an entire display area of a pixel which includes said one of said plurality of sub-pixels.

According to the arrangement above, the lighting by one sub-pixel can be used for the lighting of the entire pixel area of the pixel, by means of the light diffusion layer. When only one of the sub-pixels is turned on, i.e. only a part of the pixel is lightened, the remaining parts of the pixel are not lightened so that an image reproduced by the liquid crystal display appears jaggy, i.e. pixels appear to be distanced from each other. To solve this problem, the above-mentioned light diffusion layer is provided so that the whole pixel is lightened. With this, the jaggy appearance is eliminated and the liquid crystal display can reproduce a smooth image.

For a fuller understanding of the nature and advantages of the invention, reference should be made to the ensuing detailed description taken in conjunction with the accompanying drawings.

DESCRIPTION OF THE EMBODIMENTS

First Embodiment

Figure 1:
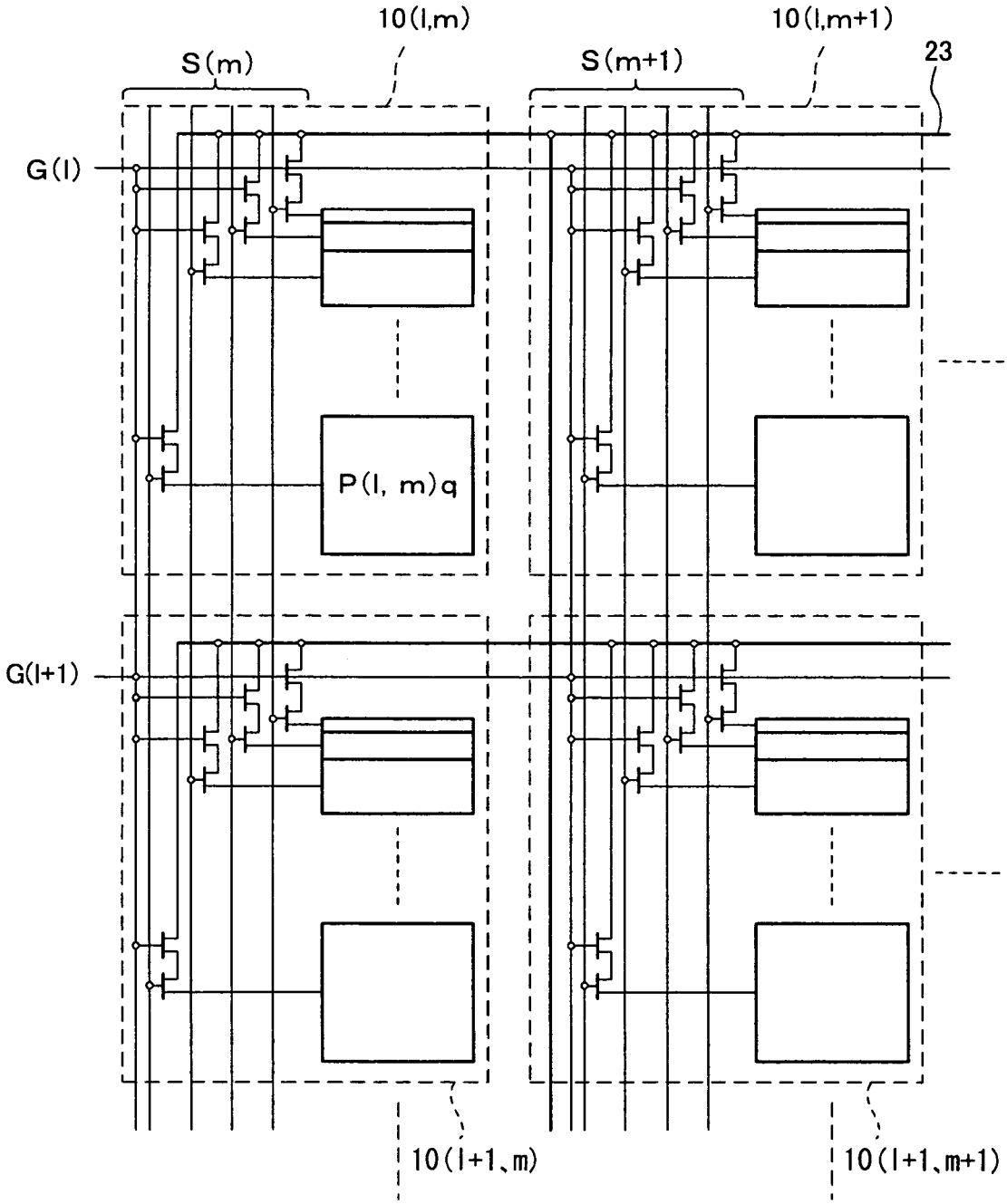
FIG. 1 is a plan view, showing pixels included in a liquid crystal display of an embodiment of the present invention.
Figure 2:
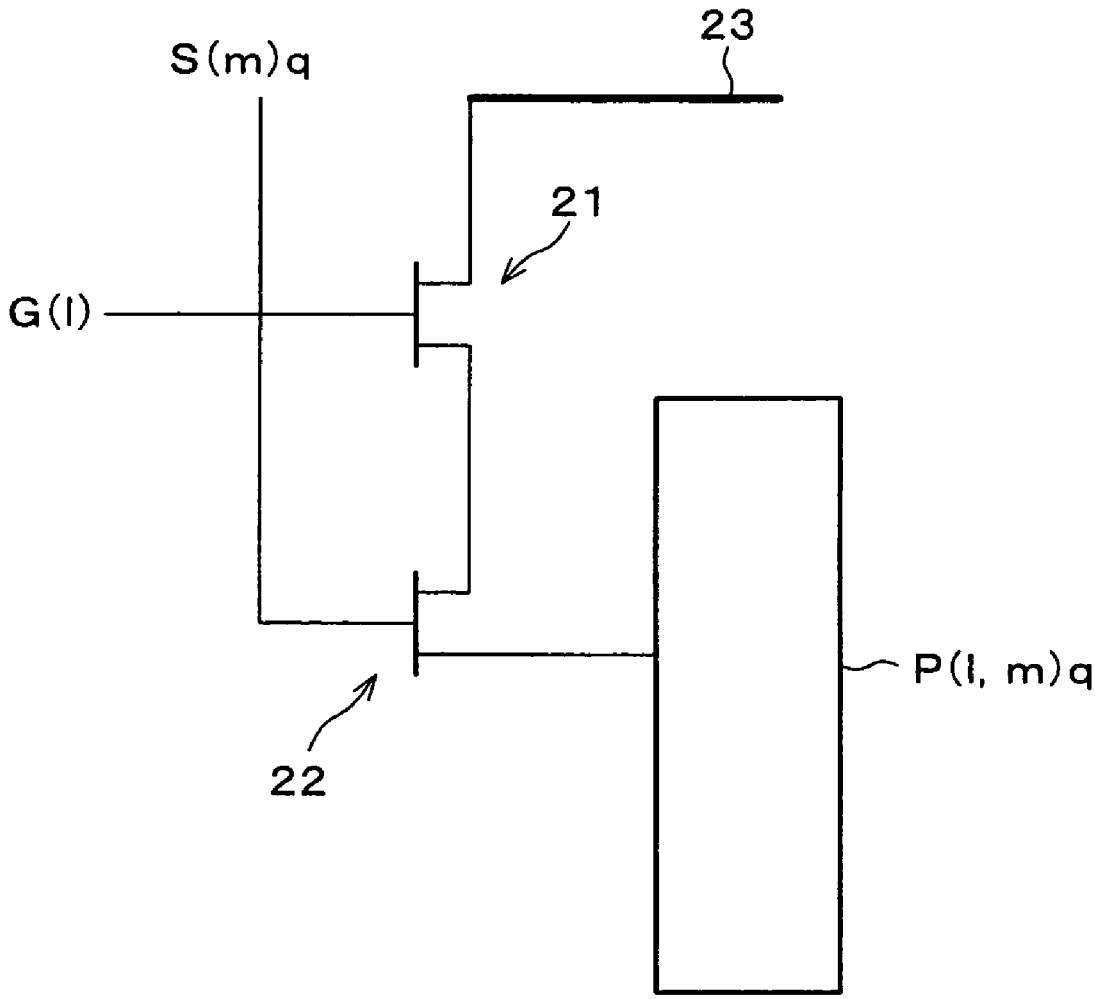
FIG. 2 is a plan view, showing one sub-pixel of the pixels in FIG. 1.

The following will describe a liquid crystal display of the present embodiment with reference to FIGS. 1 and 2.

The liquid crystal display of the present embodiment is an active matrix liquid crystal display adopting TFT (Thin Film Transistor) elements.

In the active matrix liquid crystal display, as FIG. 1 shows, liquid crystal is changed between a pair of transparent substrates (not illustrated), and pixels 10 are disposed in a matrix manner. Further, the liquid crystal display of the present embodiment reproduces images by means of an area ratio gray scale.

On one of the pair of substrates, as illustrated in FIG. 1, scanning signal lines G(l) (l=0, 1, 2, . . . ) to which scanning signals are serially supplied from a scanning signal line drive circuit (not illustrated) and data signal lines S(m) (m=0, 1, 2, . . . ) to which data signals are serially supplied from a data signal line drive circuit (not illustrated) are provided in an orthogonal manner. In the vicinity of the respective intersections between the scanning signal lines G(l) and data signal lines S(m), TFTs which are a plurality of switching elements are provided, and on the respective intersections between the scanning signal lines G(l) and data signal lines S(m), the pixels (l, m) are provided. The data signal lines S(m) are further divided into 8 different types of data signal lines (in the present embodiment, namely data signal lines S(m)0–S(m)7).

Each of the pixels 10(l, m) is made up of sub-pixels which include sub-pixel electrodes P(l, m)q (in the present embodiment, 8 sub-pixel electrodes P(l, m)0 to P(l, m)7), respectively. Each of the sub-pixels is further provided with a common electrode (not illustrated) which faces each of the sub-pixel electrodes P(l, m)0 to P(l, m)7 and is made up of a transparent conductive film. To this common electrode, an opposing common line (not illustrated) through which a common signal is supplied is connected. Each of the sub-pixel electrodes P(l, m)0 to P(l, m)7 and the opposing common electrode constitute a capacitor for holding a liquid crystal capacity as liquid crystal. The areas of the sub-pixel electrodes P(l, m)0 to P(l, m)7 are, for instance, arranged so as to give a geometric series where any two consecutive terms is 2, in order to carry out gray-scale image reproduction by these electrodes.

To the sub-pixel electrodes P(l, m)0 to P(l, m)7, scanning signals are supplied through scanning signal lines G(l) and data signals are supplied through corresponding data signal lines S(m)0 to S(m)7, so that the sub-pixels are driven. As a result, the pixel 10(l, m) carries out the gray-scale image reproduction corresponding to the number of sub-pixel electrodes P(l, m)0 to P(l, m)7 into which the data signals are written (i.e. the number of sub-pixels to be driven). That is to say, the sub-pixels constituting the pixel 10(l, m) receive binary data signals (digital signals) corresponding to either display or non-display, so that the gray-scale image reproduction corresponding to the total area of the sub-pixels in the state of display is carried out. Note that, the data signals corresponding to a predetermined gray-scale image reproduction are supplied through respective data signal lines S(m)0 to S(m)7, in order to carry out predetermined gray-scale image reproduction (i.e. in order to obtain an area for realizing the predetermined gray-scale image reproduction). As a result, only predetermined sub-pixels are turned on. It is also noted that the liquid crystal used in the present embodiment is preferably liquid crystal such as ferroelectric liquid crystal, in which the intermediate state of liquid crystal inversion angle can be ignored.

Now, as an example, one of the sub-pixels will be specifically described with reference to FIG. 2. The sub-pixels are substantially identical with each other, except that the sub-pixels differ from each other in terms of the area of the sub-pixel electrodes P(l, m)0 to P(l, m)7 and are connected to data signal lines S(l, m)0 to S(m)7, respectively. In the present example, a sub-pixel including a sub-pixel electrode P(l, m)q (q=0, 1, . . . , or 7) is discussed.

As shown in FIG. 2, each of the sub-pixels includes the sub-pixel electrode P(l, m)q and two TFTs 21 and 22.

More specifically, the drain electrode of the TFT (second thin film layer transistor) 22 is connected to the sub-pixel electrode P(l, m)q. Meanwhile, the gate electrode of the TFT 22 is connected to a data signal line S(m)q. The source electrode of the TFT22 is connected to the drain electrode of the TFT 21. The gate electrode of the TFT (first thin film layer transistor) 21 is connected to a scanning signal line G(l). The source electrode of the TFT 21 is connected to a TFT common line 23 to which a predetermined voltage is applied.

The following will describe an example when data is written into the sub-pixel electrode P(l, m)q, i.e. when the sub-pixel electrode P(l, m)q is electrically charged.

First, a source signal is supplied to the data signal line S(m)q so that one sub-pixel electrode P ((l, m)q) to be charged is selected. In short, the gate electrode of the TFT 22 receives the source signal. On this occasion, the TFT common line 23 receives a predetermined voltage, i.e. the source electrode of the TFT 21 receives a predetermined voltage.

Then a gate signal is applied to the scanning signal line G(l) so that the gate electrode of the TFT 21 receives the gate signal. Since, at this moment, the source electrode of the TFT 21 is receiving a predetermined voltage, a voltage is applied to the drain electrode of the TFT 21, and then a voltage is the source electrode of the TFT 22. Furthermore, since the gate electrode of the TFT 22 is receiving the source signal, the drain electrode of the TFT 22 receives a voltage. With this, the data is written into the sub-pixel electrode P(m)q (i.e. the sub-pixel electrode P(m)q is electrically charged). Subsequently, a scanning signal is supplied to a scanning signal line G(l+1).

According to the above, since the gate electrode of the TFT 22 has a high impedance, the TFT 22 is turned on immediately after the supply of the source signal to the gate electrode of the TFT 22. In other words, it is possible to supply a uniform voltage to the sub-pixel electrode P(m)q through the TFT common line 23. With this, the sub-pixel electrode P(m)q can be speedily charged.

As described above, the liquid crystal display of the present embodiment can supply a uniform voltage to sub-pixel electrodes of different sub-pixels through the TFT common line, when a single color is displayed on a whole liquid crystal panel, i.e. when identical signals are supplied to all pixels. That is to say, a uniform voltage can be supplied even to a sub-pixel electrode far from the source driver, and this makes it possible to improve the speed of electric charge. With this, the speed of response is also improved. Thus, different sub-pixel electrodes can be charged in an identical manner, substantially regardless of the transient characteristics (e.g. resistance) of the data signal lines, and hence different pixels can carry out the image reproduction in a substantially uniform manner. This makes it possible to perform uniform image reproduction on a large-sized liquid crystal display.

Note that, the data signal line S(m)q is, in the example above, connected to the gate electrode of the TFT 22. Since the gate electrode of the TFT 22 has a high impedance, the data signal line S(m)q can be thinned down.

It is preferable that the TFT common line 23 is formed so as to overlap a black matrix formed around the pixel. With this, it is possible to prevent the reduction of transmittance of the pixel being turned on.

In the present embodiment, the gate electrode of the TFT 22 is connected to the data signal line, and the gate electrode of the TFT 21 is connected to the scanning signal line. However, the lines connected to the gate electrodes may be swapped.

Second Embodiment

Figure 3:
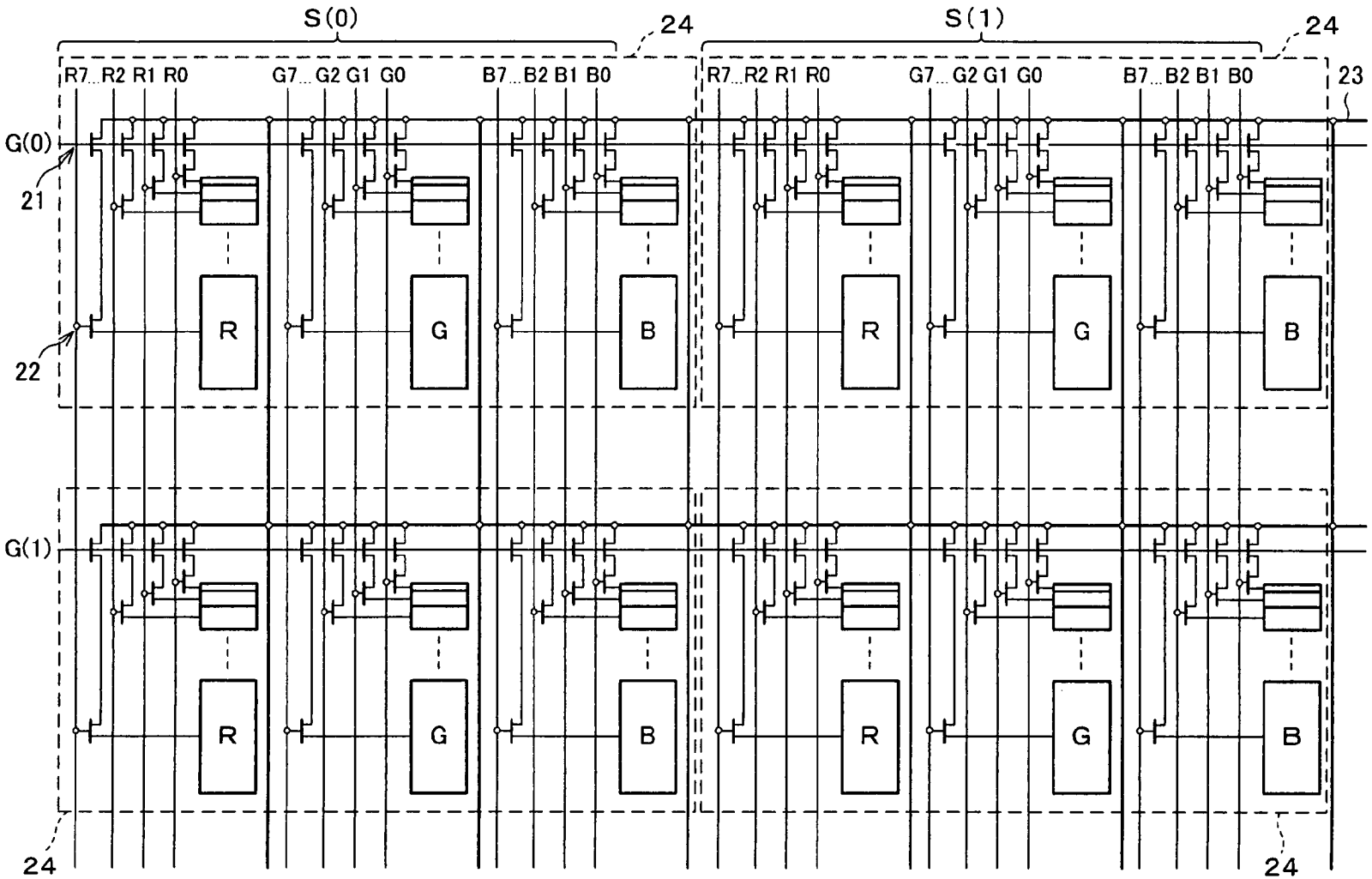
FIG. 3 is a plan view, showing pixels of a liquid crystal display of another embodiment of the present invention.
Figure 4:
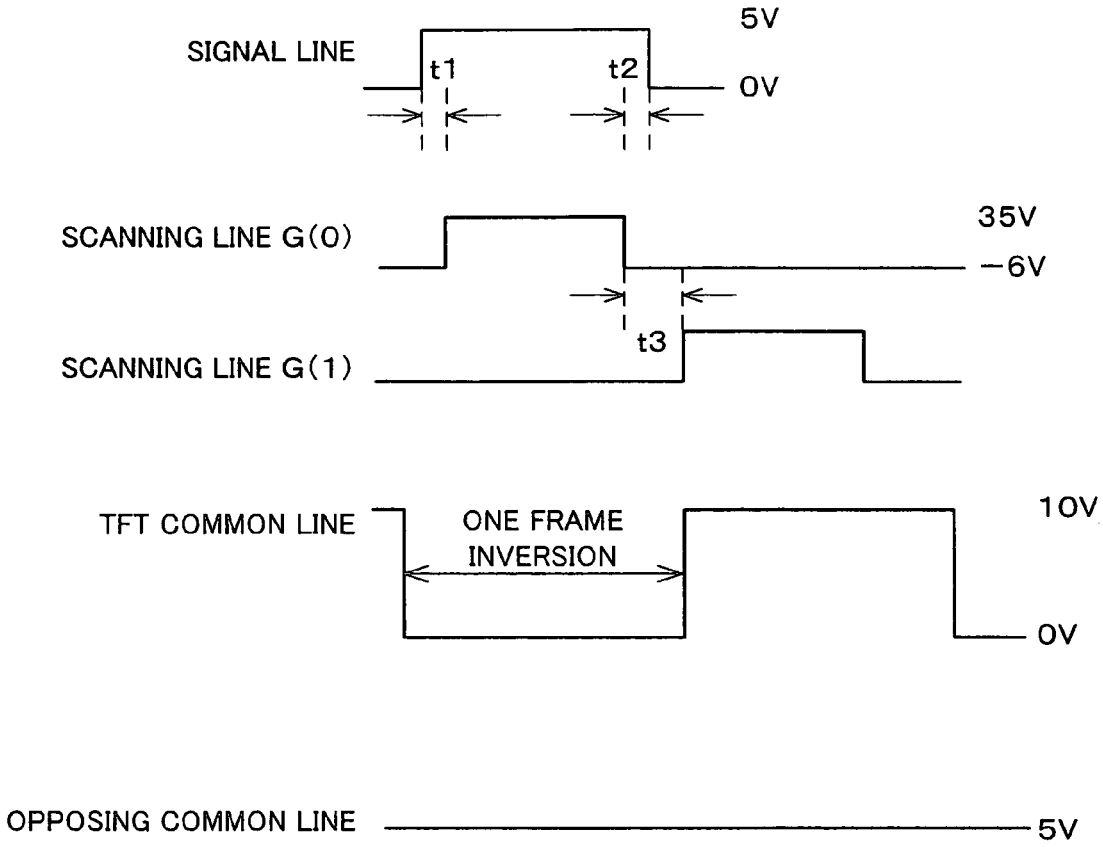
FIG. 4 illustrates respective waveforms of signals applied to lines when the pixels of the liquid crystal display in FIG. 3 are driven.

This embodiment will describe an example of a color liquid crystal display with reference to FIGS. 2–4. By the way, members having the same functions as those described in First Embodiment are given the same numbers, so that the descriptions are omitted for the sake of convenience.

As FIG. 3 indicates, a liquid crystal display of the present embodiment is identical with the liquid crystal display of First Embodiment, except that the display of the present embodiment includes picture elements 24 each made up of three pixels corresponding to red (R), green (G), and blue (B). Note that, the sub-pixels in each pixel are identical with those of First Embodiment shown in FIG. 2. In the present embodiment, furthermore, data signal lines connected to the respective pixels (R), (G), and (B) of one picture element 24 constitute a single data signal line S(0) (or S(1) . . . ). Also, the pixels of the liquid crystal display, which are connected to one scanning signal line, are also connected to one TFT common line 23. This makes it possible to perform color image reproduction.

Referring to FIG. 4, how one sub-pixel in the liquid crystal display is driven is described below. FIG. 4 shows signal waveforms in a data signal line, scanning signal line, TFT common line, and opposing common line, when one sub-pixel in the picture element 24 is driven. It is noted that voltages in the figure are mere examples.

As shown in FIG. 4, the liquid crystal display of the present embodiment is arranged in such a manner that a voltage applied to the TFT common line is frame-inverted in accordance with a scanning signal applied to the scanning signal line (i.e. frame-inverted in each scanning period). That is to say, the polarity of the voltage applied to the TFT common line is reversed with respect to a voltage of the opposing common line, at predetermined frame-inversion intervals. Note that, the voltage applied to the opposing common line has a constant value.

More specifically, the drive of the sub-pixel is arranged such that the source signal is applied to the data signal line so that the source signal is also applied to the gate electrode of the TFT 22 shown in FIG. 3. On this occasion, the TFT common line 23 receives a predetermined voltage, and the source electrode of the TFT 21 also receives a predetermined voltage.

After a period t1 has passed, the gate signal is applied to the scanning signal line G(0) so that the gate signal is also applied to the gate electrode of the TFT 21. On this occasion, since the source electrode of the TFT 21 is receiving a predetermined voltage, the drain electrode of the TFT 21 also receives a voltage and the source electrode of the TFT 22 receives a voltage. Furthermore, the gate electrode of the TFT 22 receives the source signal so that a voltage is applied to the drain electrode of the TFT 22. With this, data is written into the sub-pixel electrode (i.e. the sub-pixel electrode is electrically charged).

When a period t2 after the application of the gate signal to the scanning signal line G(0) has passed, the application of the source signal is terminated. Subsequently, when a period t3 after the application of the scanning signal to the scanning signal line G(0) has passed, the scanning signal is then applied to the next scanning signal line G(1).

Third Embodiment

Next, another example of the color liquid crystal display will be discussed with reference to FIGS. 5 and 6. By the way, members having the same functions as those described in First and Second Embodiments are given the same numbers, so that the descriptions are omitted for the sake of convenience.

Figure 5:
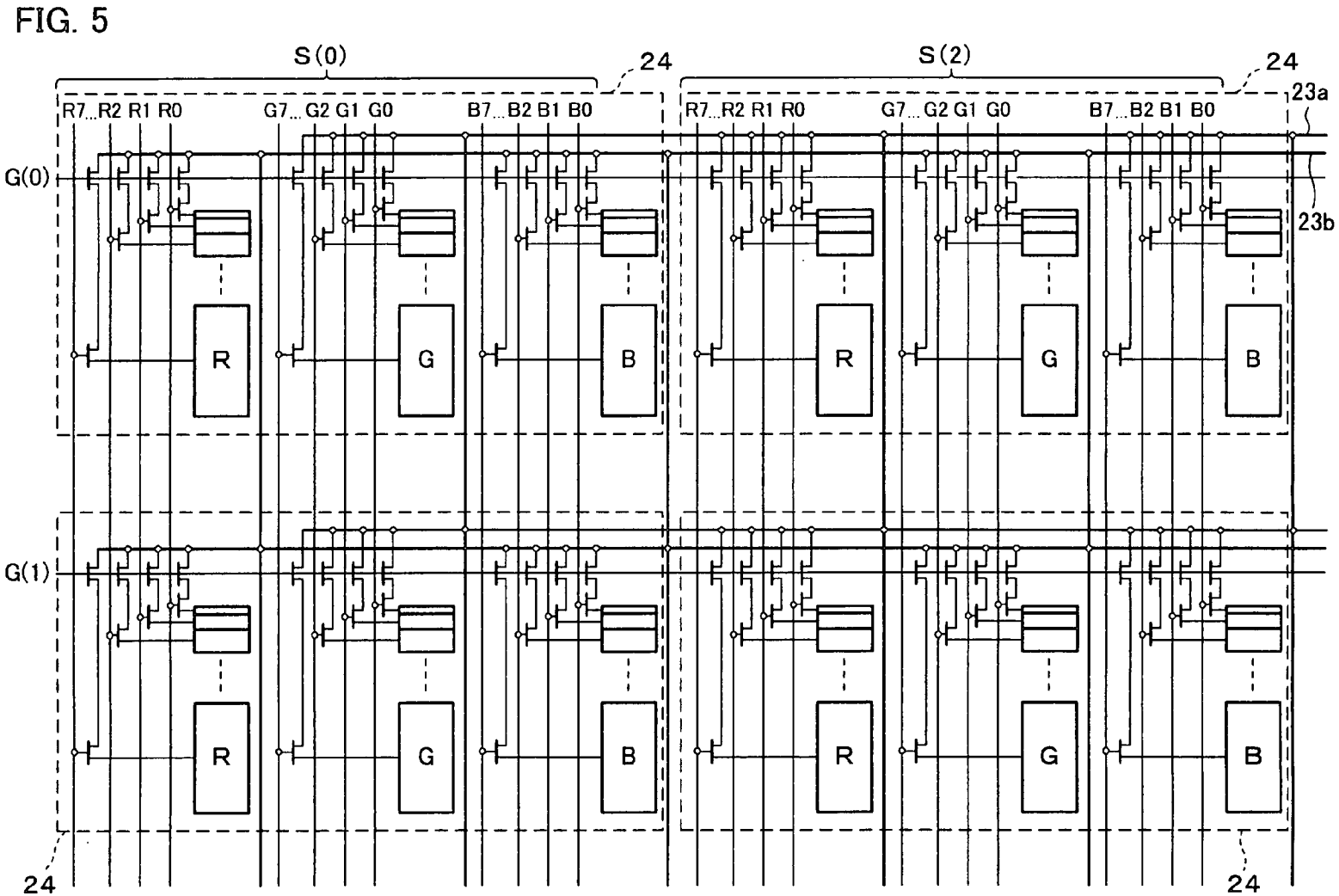
FIG. 5 is a plan view, showing pixels of a liquid crystal display of a further embodiment of the present invention.

The liquid crystal display of the present embodiment is, as in FIG. 5, includes picture elements 24 each made up of three pixels corresponding to red (R), green (G), and blue (B), as in the case of the liquid crystal display 2 in Second Embodiment. In this manner, to reproduce color images, a black mask and R, G, and B color filters are provided on a substrate on which sub-pixel electrodes are not provided, and the black mask and R, G, and B color filters correspond to respective pixels. In the present liquid crystal display, furthermore, pixels connected to one scanning signal line are alternately connected to a TFT common line 23*a* and a TFT common line 23*b* in the direction parallel to the scanning signal line. In other words, two neighboring pixels are connected to different TFT common lines 23*a* and 23*b*.

Figure 6:
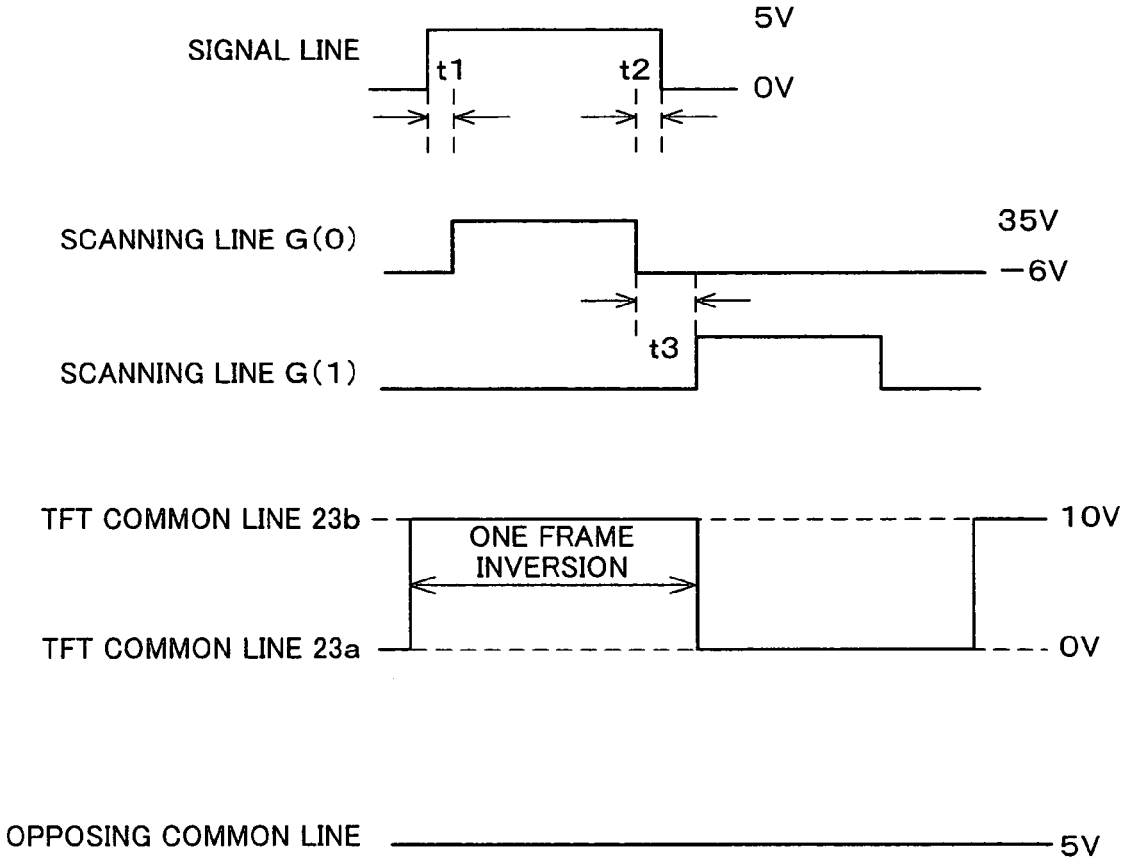
FIG. 6 illustrates respective waveforms of signals applied to lines when the pixels of the liquid crystal display in FIG. 4 are driven.

Referring to FIG. 6, how one sub-pixel in the liquid crystal display is drive is described below. FIG. 6 shows signal waveforms in a data signal line, scanning signal line, TFT common line, and opposing common line, when one sub-pixel in the picture element 24 is driven. It is noted that voltages in the figure are mere examples.

As illustrated in FIG. 6, the liquid crystal display of the present embodiment is arranged in such a manner that the TFT common line 23*a* and TFT common line 23*b* receive respective voltages having opposite polarities in each frame. In each of the TFT common lines 23*a* and 23*b*, frame inversion is carried out in accordance with the scanning signal applied to the scanning signal line (i.e. frame inversion is carried out in each scanning period). With this, two neighboring pixels carry out image reproduction with respective voltages having opposite polarities, and this prevents the occurrence of flicker. As a result, it is possible to improve the quality of reproduced images on the liquid crystal display.

Fourth Embodiment

A liquid crystal display of the present embodiment will be discussed with reference to FIG. 7. By the way, members having the same functions as those described in First to Third Embodiments are given the same numbers, so that the descriptions are omitted for the sake of convenience.

Figure 7:
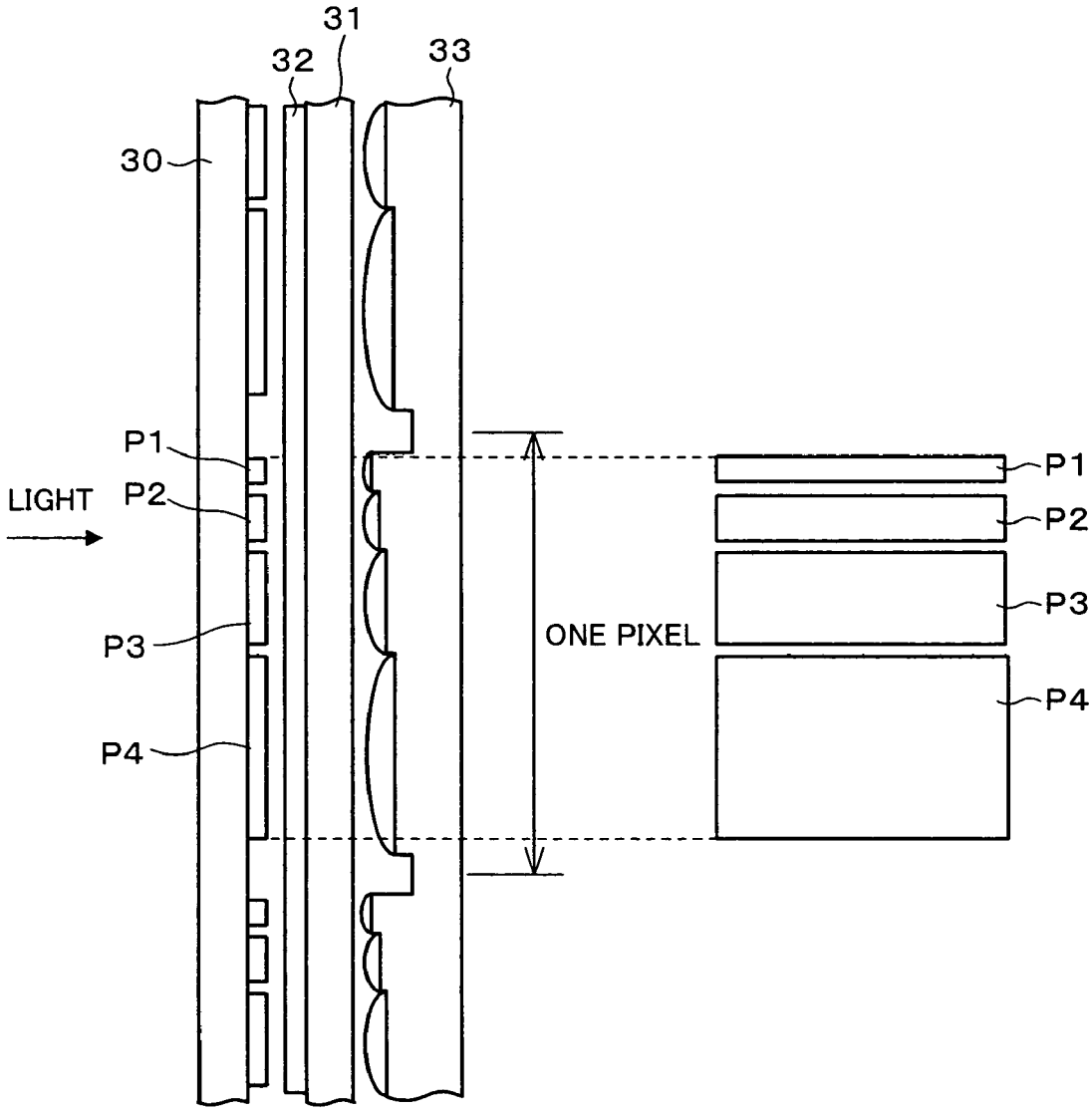
FIG. 7 is a cross section of a substantial part of a liquid crystal display of yet another embodiment of the present invention, and also a plan view of pixel electrodes.

The liquid crystal display of the present embodiment is, as shown in FIG. 7, provided with sub-pixel electrodes P1–P4 formed on a substrate 30 and a substrate 31 opposing the substrate 30. That surface of the substrate 31 which faces the substrate 30 is provided with an opposing electrode 32. Between the sub-pixel electrodes P1–P4 and the opposing electrode 32, a liquid crystal layer (not illustrated) is disposed. On that surface of the substrate 31 which is not facing the substrate 30, a light diffusion layer 33 is disposed.

The light diffusion layer 33 is a layer which causes light which passes through the liquid crystal layer to diffuse and cover the entirety of the pixel made up of the sub-pixel electrodes P1–P4, when the sub-pixel electrodes P1-P4 are turned on. With this, the gray-scale image reproduction can be performed on the entirety of the pixel.

In the present embodiment, the light diffusion layer 33 includes a plurality of (four in the present embodiment) lens sections corresponding to the sub-pixel electrodes P1–P4, in order to diffuse the light passing through the liquid crystal layer (i.e. light emitted from the sub-pixels) when the sub-pixels are turned on by driving the sub-pixel electrodes P1–P4.

For instance, when only one of the sub-pixel electrodes P1–P4 is turned on, there are areas of the pixels in which the sub-pixel electrodes are not turned on. In other words, only a part of the pixel is lightened so that an image reproduced by the liquid crystal display appears jaggy, i.e. pixels appear to be distanced from each other. To solve this problem, the above-mentioned light diffusion layer 33 is provided so that the whole pixel is lightened (i.e. the area for display is increased). With this, the jaggy appearance is eliminated and the liquid crystal display can reproduce a smooth image.

In the present embodiment, the pixel is made up of 4 sub-pixel electrodes. However, the number of the sub-pixel electrodes may be arbitrarily determined such as 6 and 8. When the number of the sub-pixel electrodes is altered, the number of the lens section of the light diffusion layer is also altered so as to correspond to the sub-pixel electrodes. Thus, it is possible to provide a 6-bit or 8-bit liquid crystal display, apart from the 4-bit display.

Furthermore, although the light diffusion layer is additionally provided in the above-described example, the light diffusion layer may be formed in combination with a polarizer on the substrate 31 or a color filter.

Fifth Embodiment

Figure 8:
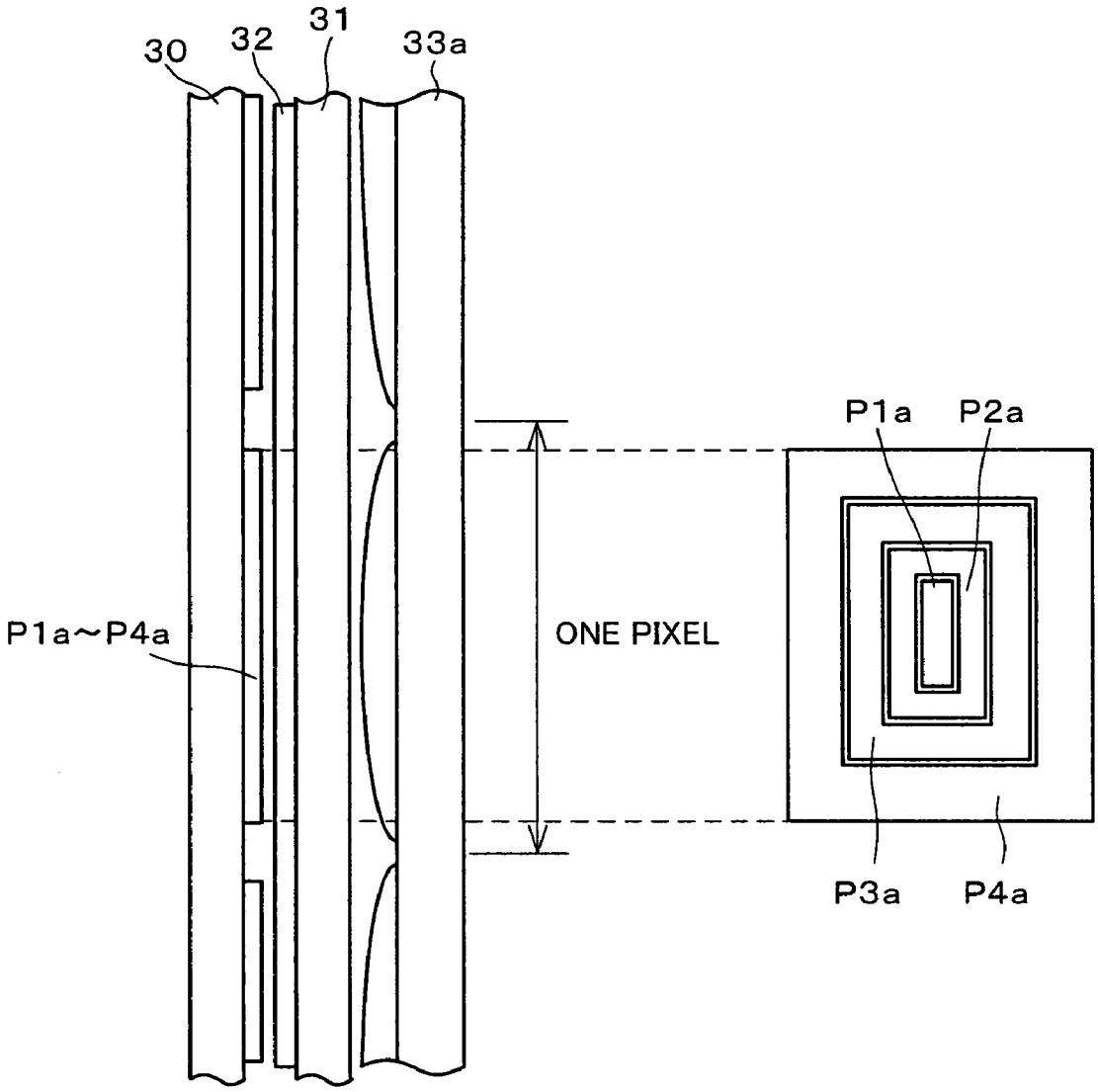
FIG. 8 is a cross section of a substantial part of a liquid crystal display of still another embodiment of the present invention, and also a plan view of pixel electrodes.
Figure 9:
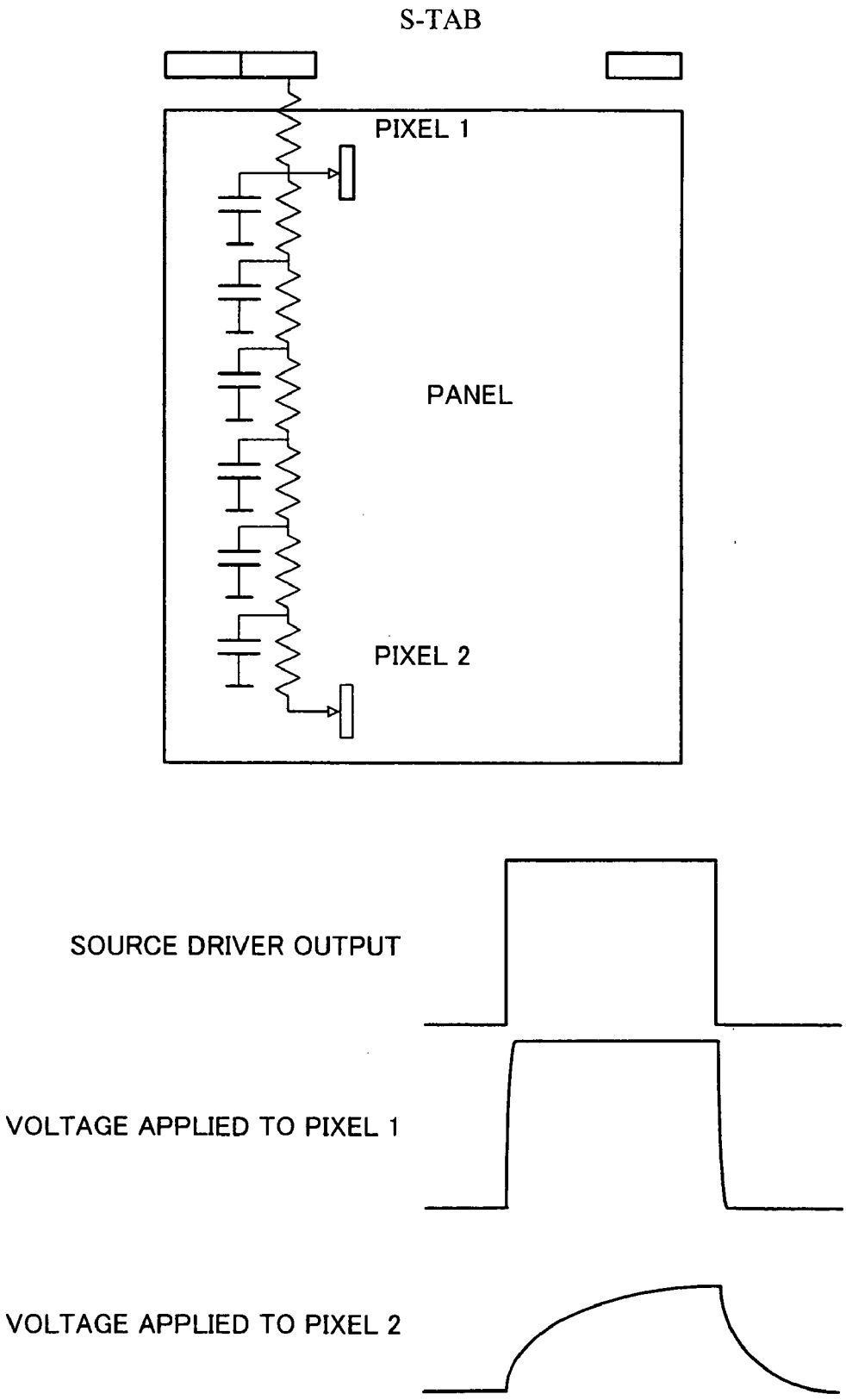
FIG. 9 includes a rough plan view of a conventional matrix liquid crystal display, and a waveform chart of a source signal supplied from a source driver to pixels 1 and 2 of the liquid crystal display.

The following will describe a liquid crystal display of the present embodiment with reference to FIG. 8. By the way, members having the same functions as those described in First to Fourth Embodiments are given the same numbers, so that the descriptions are omitted for the sake of convenience.

The liquid crystal display of the present embodiment is identical with the liquid crystal display of Fourth Embodiment, except the constructions of the sub-pixel electrodes and the light diffusion layer.

More specifically, as FIG. 8 illustrates, rectangular-shaped sub-pixel electrodes P1*a*–P4*a* in the liquid crystal display of the present embodiment are disposed in a concentric manner. That is to say, the smallest sub-pixel electrode P1*a* which is rectangular-shaped is provided in an opening at the center of the second smallest sub-pixel electrode P2*a* which is rectangular-shaped, the sub-pixel electrode P2*a* is provided in an opening at the center of the sub-pixel electrode P3*a* which is rectangular shaped, and these sub-pixel electrodes P1*a*–P3*a* are provided in an opening at the center of the largest sub-pixel electrode P4*a* which is rectangular-shaped.

A light diffusion layer 33*a* of the present embodiment includes lens sections corresponding to the respective sub-pixel electrodes P1*a*–P4*a*. This light diffusion layer 33*a* allows the light passing through the liquid crystal layer to diffuse and cover the entirety of the pixel made up of the sub-pixel electrodes P1*a*–P4*a*, when the sub-pixel electrodes P1*a*–P4*a* are turned on. Since the rectangular-shaped sub-pixel electrodes P1*a*–P4*a* are provided in a concentric manner, it is not necessary to provide more than one lens sections.

Also in the present embodiment, the number of the sub-pixel electrodes may be arbitrarily determined such as 6 and 8. When the number of the sub-pixel electrodes is altered, the number of the lens section of the light diffusion layer is also altered so as to correspond to the sub-pixel electrodes. Thus, it is possible to provide a 6-bit or 8-bit liquid crystal display, apart from the 4-bit display.

In the liquid crystal display of the present invention, it is preferable that the common line is made up of a first common line and a second common line to which respective voltages having opposite polarities are applied, and the first common line and the second common line are connected to said plurality of sub-pixels in neighboring two of said pixels.

According to this arrangement, two neighboring pixels can carry out image reproduction by respective voltages having opposite polarities, and this makes it possible to restrain the occurrence of flicker. For this reason, it is possible to improve the quality of images reproduced by the liquid crystal display.

The liquid crystal display of the present invention is preferably arranged in such a manner that the common line is formed so as to overlap a black matrix formed around each of said plurality of pixels.

According to this arrangement, since the common line is formed so as to overlap the black matrix, it is possible to prevent the reduction of transmittance of the pixel being turned on.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display, comprising:

a plurality of data signal lines;

a plurality of scanning signal lines intersecting with said plurality of data signal lines; and a plurality of pixels provided in a matrix manner at respective intersections of said plurality of data signal lines and said plurality of scanning signal lines, each of said plurality of pixels including a plurality of sub-pixels driven in a binary manner, wherein, each of said plurality of sub-pixels includes a sub-pixel electrode, a first thin film layer transistor, and a second thin film transistor, and is connected to a common line to which a predetermined voltage is applied, a source electrode and a drain electrode of the second thin film layer transistor are connected to a drain electrode of the first thin film transistor and the sub-pixel electrode, respectively, and a source electrode of the first thin film layer transistor is connected to the common line, and a gate electrode of the first thin film layer transistor is connected to one of said plurality of scanning signal lines or one of said plurality of data signal lines, and a gate electrode of the second thin film layer transistor is connected to one of said plurality of scanning signal lines or one of said plurality of data signal lines, which is not connected to the gate electrode of the first thin film layer transistor.

2. The liquid crystal display as defined in claim 1, wherein, the common line is made up of a first common line and a second common line to which respective voltages having opposite polarities are applied, and the first common line and the second common line are connected to said plurality of sub-pixels in neighboring two of said pixels.

3. The liquid crystal display as defined in claim 1, wherein, the common line is formed so as to overlap a black matrix formed around each of said plurality of pixels.

4. The liquid crystal display as defined in claim 1, wherein, a voltage applied to the common line is frame-inverted in accordance with the scanning signal applied to one of said plurality of scanning signal lines, in each scanning period.

5. The liquid crystal display as defined in claim 1, wherein, three of said plurality of pixels, which correspond to red (R), green (G), and blue (B), constitute a picture element.

* * * * *